US005988796A

United States Patent [19]

Yamanaka

[11] Patent Number: 5,988,796

[45] **Date of Patent: *Nov. 23, 1999**

[54] RECORDING HEAD AND RECORDING APPARATUS USING SUCH RECORDING HEAD

[75] Inventor: Akihiro Yamanaka, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/508,539

[22] Filed: Jul. 28, 1995

[30] Foreign Application Priority Data

Jul. 29, 1994 [JP] Japan ..... 6-178968

[51] Int. Cl.[6] ..... B41J 2/05

[52] U.S. Cl. ..... 347/58; 361/212

[58] Field of Search ..... 347/58, 57, 50; 361/212, 220, 761, 764

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,723,129 | 2/1988 | Endo et al. . | |
| 4,740,796 | 4/1988 | Endo et al. . | |
| 5,243,363 | 9/1993 | Koizumi | 347/50 |
| 5,315,472 | 5/1994 | Fong | 361/212 |
| 5,428,498 | 6/1995 | Hawkins | 361/212 |

FOREIGN PATENT DOCUMENTS

| | | | |
|---|---|---|---|
| 57-125543 | 7/1982 | Japan | B41J 3/20 |
| 4-284268 | 10/1992 | Japan | B41J 2/375 |

*Primary Examiner*—Joseph Hartary

*Attorney, Agent, or Firm*—Fitzpatrick, Cella, Harper & Scinto

[57] ABSTRACT

A recording head is structured so that its elements are not easily destructed by the fusion of wiring due to electrostatic discharge, and a recording apparatus uses such recording head. A part of GND wiring on a wiring board is exposed. A base plate and the GND wiring on the wiring board is electrically connected by caulking a caulking pin arranged for such exposed portion. The resistance of the connected path is made lower than that of wires and others on a heater board. Also, even in a case where the base plate and the GND wiring on the wiring board are not directly in contact, the exposed portion of the GND wiring on the wiring board and the base plate are arranged to be extremely close to each other, hence making it possible to form such a low-resistance path.

25 Claims, 4 Drawing Sheets

RECORDING HEAD AND RECORDING APPARATUS USING SUCH RECORDING HEAD

BACKGROUND OF THE INVENTION

1. Field of the Invention

The present invention relates to a recording head and a recording apparatus. More particularly, the invention relates to an ink jet head and a recording apparatus using the ink jet head. In this respect, recording includes the application of ink or the like (print) for all the ink carriers capable of receiving the application of ink, such as cloth, thread, paper, and sheet materials. The recording apparatus includes all information apparatuses of the various kinds or printers serving as its output equipment. The present invention is applicable to the use of such ink carriers and apparatuses.

2. Related Background Art

As an ink jet method to discharge ink, there has been known the so-called bubble jet method in which ink is rapidly heated when driving heat generating resistive elements arranged on a heater board formed of Si substrate so that ink is discharged from the discharge ports of the recording head.

FIG. 5 is an exploded perspective view which shows the structure of the principal part of a recording head using such a conventional bubble jet method. In FIG. 5, a reference numeral 1 designates a plurality of heat generating elements (not shown) and a heater board (elemental substrate) on which the functional elements are electrically connected to the heat generating elements to drive them selectively; and 2, a wiring board for transmitting to the heater board the signals received from an apparatus having the head mounted on it. This wiring board 2 is electrically connected to the heater board 1 through a wire bonding portion 3. This board is also provided with a card edge connector 2A. The card edge connector 2A is a coupler to connect the apparatus main body (not shown in FIG. 5) and the wiring board 2 electrically.

The heater board 1 and the wiring board 2 are fixed to a base plate 4 by the application of bonding agent. The base plate 4 functions as a positioning board for the heater board dually with respect to the apparatus main body. In general, this plate is formed by Al (aluminum) or other metallic material. On the heater board, plural grooves are formed corresponding to the heat generating elements. This grooved ceiling plate 6 is connected to the heater board to provide liquid paths and a liquid chamber. A reference numeral 5 designates an ink container, which is fixed to the base plate 4, and also, conductively connected to the liquid paths and liquid chamber.

FIG. 6 is a cross sectional view schematically showing the structure of the recording head whose heat generating elements and functional elements are prepared on the same substrate, located near the heater board 1. In FIG. 6, the heater board 1 is formed by an Si substrate layer 1A and an element formation layer 1B. Also, a reference numeral 6 designates the grooved ceiling plate to form the ink paths and liquid chamber; 7, ink; and 8, a recording material to receive the application of ink. Recording is made by the ink droplets 7A to be discharged by the application of heat generated by a heater (not shown). A recording head of the kind, in which its heat generating elements and functional elements are formed on the same substrate, occupies the leading position among the heads available in recent years because it is possible for this kind of head to decrease the number of electrically connected wires between the recording apparatus main body and the recording head even when the number of nozzles (liquid paths) is increased. Here, each of the functional elements is produced by the usual semiconductor fabrication processes. Generally, the substrate layer 1A of the heater board discharges to the apparatus side through the aforesaid wiring board. Therefore, this layer is usable as GND potential.

FIG. 7 is a perspective view which schematically shows one example of the ink jet recording apparatus on which the aforesaid recording head can be installed. In FIG. 7, a reference numeral 13 designates a carriage to hold the recording head 12, which is connected to a part of a driving belt 15 that transmits the driving force of a driving motor 14. The carriage is slidably mounted on two guide shafts 16A and 16B arranged in parallel to each other so as to enable the recording head 12 to reciprocates over the entire width of the recording sheet. Here, when the recording head 12 is installed on the carriage 13, it is electrically connected to the recording apparatus main body through a flexible cable 11.

Now, the recording head shown in FIG. 5 and FIG. 6 is provided with the electrical wiring (circuit) as described above. Therefore, if such recording head is of an exchangeable type, a problem is encountered: electrostatic destruction (ESD) may occur in exchanging heads.

As a countermeasure in this respect, it is conceivable that the recording head is covered with an insulating resin or the like as much as possible. As shown in FIG. 5, however, there is need for the base plate 4 of the recording head to be exposed in order to serve as the electrical connector 2A and the positioning board as well with respect to the apparatus main body. This requirement makes it impossible to cover the head with resin entirely. Now, supposing that this recording head is installed on the recording head shown in FIG. 7, for example, the electrical connector is in a condition that the user is not allowed to touch the connector and couple it to the main body of the recording apparatus, but the base plate 4 is still in a state of being exposed. If the user who is electrostatically charged intends to change the recording heads in this state, the probability is still high that static electricity is transferred to the base plate 4, and then, to the heater board in spite of the insulating layer (bonding agent), thus discharging to the GND (earth) of the apparatus main body through the wire bonding portion 3 and the wiring board 2.

Particularly, in a case of a recording head having the heater board 1 whose substrate layer 1A is connected to the GND through the wiring board as shown in FIG. 6, the probability is higher that the discharge is made by way of paths described above. If the discharge is made through these paths, there is a fear that the wires on the heater board are fused or the elements that are fabricated by the application of semiconductor processes are destructed. As a countermeasure, it is conceivable that the wires on the heater board 1 are made thick so as not to be fused even when an excessive current runs or some other means may be taken to enhance the durability of the heater board 1, but the provision of such measures immediately results in making the heater board 1 larger and invites the problem of increased costs.

As another method, it is conceivable that a metallic member is arranged to surround the recording head 7 shown in FIG. 12 so that discharge is made to the metallic member instead of the base plate 4. This arrangement also results in the increase of part numbers, and immediately invites the problem of increased costs.

SUMMARY OF THE INVENTION

It is an object of the present invention to provide a recording head, which is so structured that its elements are not easily destructed by the fusion of wiring due to electrostatic discharge.

In order to achieve the object described above, an ink jet head is provided with an elemental substrate having heat generating elements for discharging ink; a wiring board for drawing out electrical connection from the elemental substrate to a recording apparatus; and a conductive supporting member to which the aforesaid wiring board and elemental substrate are fixed, and then, in accordance with the present invention the wires on the aforesaid wiring board and the supporting member are electrically connected.

Also, in accordance with another invention, a recording head is provided with an elemental substrate having heat generating elements for discharging ink; a wiring board for drawing out electrical connection from the elemental substrate to a recording apparatus; and a conductive supporting member to which the aforesaid wiring board and elemental substrate are fixed, and then, parts of wires on the wiring board are exposed, and such exposed portions and the aforesaid supporting member are closely arranged.

In the present invention, the supporting member of the recording head and the GND wiring on the wiring board are connected. Then, it is arranged that the resistance of this connecting path is lower than the resistance value of the wires and others on the wiring board. Therefore, even when the user who is electrostatically charged uses this recording head or recording apparatus, the static electricity runs on the connecting path having a lower resistance as described above, and is discharged. As a result, it is possible to prevent any excessive current from running through the wires and others on the wiring board, and enhance the characteristics of the head to withstand static electricity.

Also, in accordance with the present invention, the supporting member of the recording head and the exposed portion of the GND wiring pattern on the wiring board are arranged to be close to each other, and the discharge resistance of the passage thus formed is made lower than the resistance value of wiring and others on the heater board. As a result, even when the user who is electrostatically charged uses this recording head or recording apparatus, its static electricity runs through such lower-resistance path, and then, discharges as described above. Therefore, as in the invention described above, it is possible to prevent any excessive current from running through the wires and others on the heater board, and enhance the characteristics of the head to withstand static electricity.

DETAILED DESCRIPTION OF THE PREFERRED EMBODIMENTS

Hereinafter, with reference to the accompanying drawings, the detailed description will be made of the embodiments in accordance with the present invention.

Embodiment 1

Figure 1A:
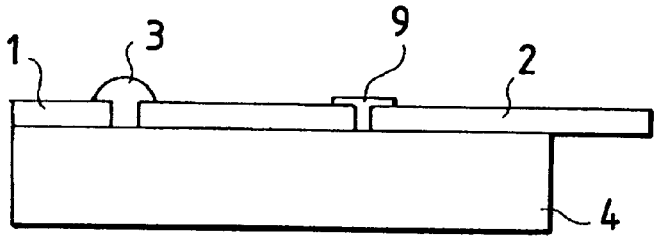
FIGS. 1A and 1B are cross-sectional views which show the principal part of a recording apparatus in accordance with the present invention.
Figure 1B:
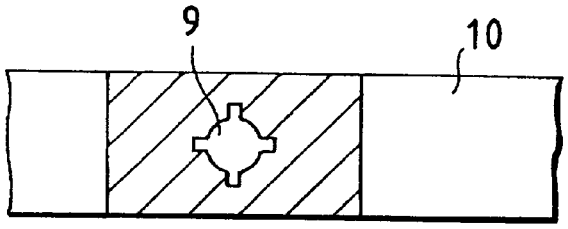

FIGS. 1A and 1B show the principal part of the first embodiment of a recording head in accordance with the present invention. FIG. 1A is a cross-sectional view schematically showing the principal part of the recording head. Each of the constituents is designated by the same reference numeral as applied to each of those shown in FIG. 5, and described accordingly as in conjunction with FIG. 5. Here, in the present embodiment, the connection between the wiring board 2 and base plate 4 is made by caulking the caulking pin 9 (embossment) extruded from the base plate 4. FIG. 1B is a view schematically showing the upper surface of the caulking section observed in the direction of the wiring pattern of the wiring board 2. The wires of the conventional wiring board 2 are covered by soldering resist with exception of the wire bonding portion 3 connecting it with the heater board (elemental substrate) 1 and its electrical connector 2A with the apparatus main body. In the present embodiment, however, a part of the GND wiring 10 of the wiring board 2, which serves as a relay board for drawing out the electrical connection from the heater board 1 to the recording apparatus, is exposed (this being indicated by slanted lines in FIG. 1B). Then this exposed section (exposed portion of the wiring pattern) is connected to the conductive supporting member 4 side by means of a conductive caulking pin 9. In this way, the GND wiring on the wiring board 2 is electrically connected with the base plate 4 serving as the supporting member.

As a material that forms the base plate in accordance with the present embodiment, it is desirable to use SUS, Al, or other metals, but it may be possible to use an insulator a part of which is made conductive if only such element functions in the same way as any one of the metallic materials described above.

Figure 2:
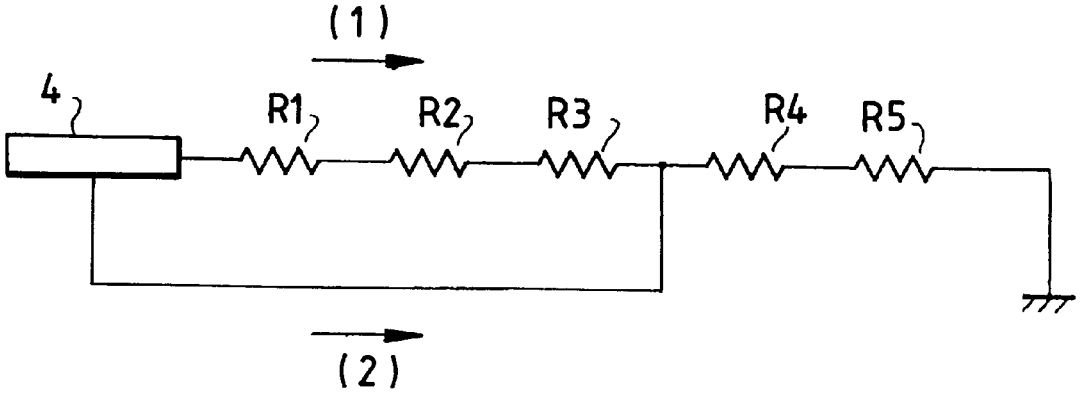
FIG. 2 is a diagram which shows the equivalent circuit of the discharging path of the recording head in accordance with the present invention.

FIG. 2 is a diagram representing the structure shown in FIGS. 1A and 1B by arranging it as an electrical circuit. In FIG. 2, a reference mark R1 designates the resistance of bonding agent fixing the heater board 1 and base plate 4; R2, the resistance of the GND wiring of the heater board 1; R3, the resistance of the GND wiring of the wire bonding portion 3; R4, the resistance of the GND wiring of the wiring board 2; and R5, the resistance of the GND wiring of the flexible cable of the apparatus main body. Also, the base plate 4 and the wiring board 2 being connected electrically in the present embodiment, the circuit is formed to make R1, R2, and R3 short.

Figure 7:
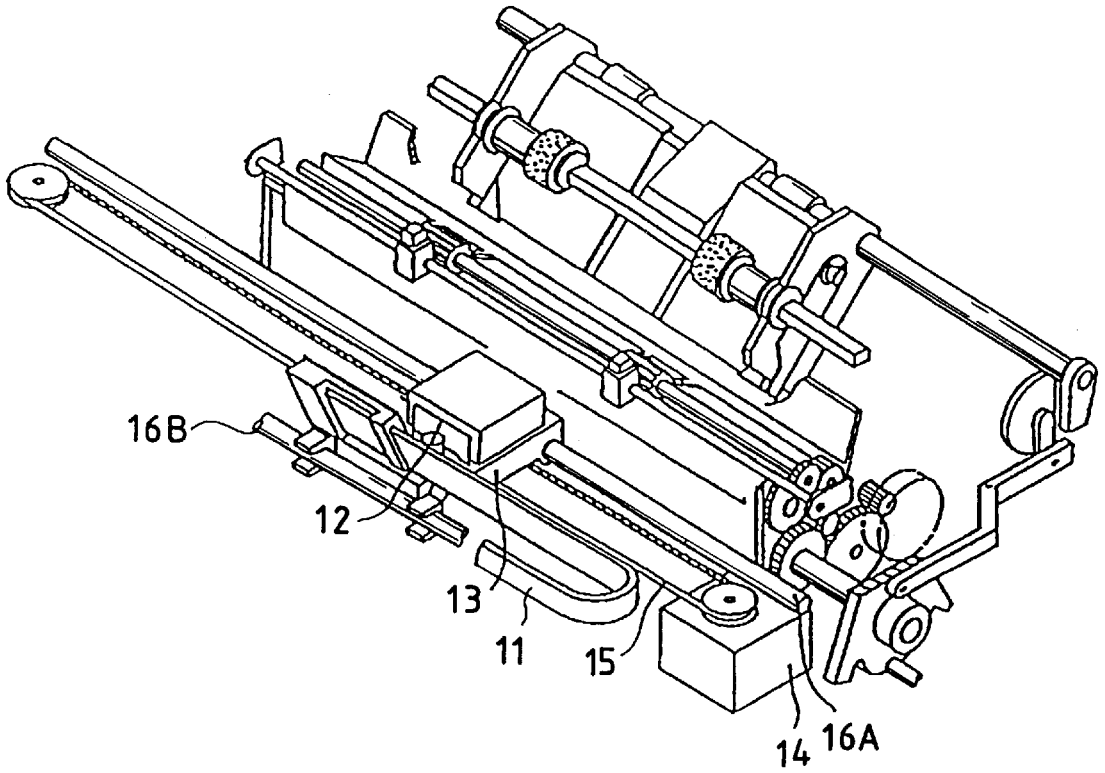
FIG. 7 PRIOR ART
FIG. 7 is a perspective view which schematically shows one example of an ink jet recording apparatus on which the recording head can be installed.

Now, when the user who is electrostatically charged intends to exchange the recording heads of the present embodiment in a state where the head is detachably installed on an ink jet recording apparatus represented in FIG. 7, for example, it is conceivable that there are two paths, (1) and (2) shown in FIG. 2, as discharging passages. When comparing these two paths, the resistance value of the path (2) is lower. Therefore, most of static electricity is discharged through the path (2). In other words, most of discharge is made in the passage of "base plate 4→wiring board 2 (R4)→flexible cable 11 (R5)→main body GND (earth)". As a result, no excessive current runs through the heater board 1. Thus there is no possibility that the recording head is destructed by such excessive current. The inventor et al hereof have examined the effectiveness of the present invention by applying static electricity to the base plate 4 under the following conditions in a state that the recording head is installed on a recording apparatus:

Discharge resistance=400 Ω

Discharge capacitance=200 pF

Applied voltage=5 to 25 kV

Applied conditions=positive and negative (±) for five times each at each of the applied voltages As a result, whereas the destruction occurs in the conventional recording heads at 15 to 20 kV, no destruction takes place even at 30 kV in the recording heads of the present embodiment.

In accordance with the present embodiment, the structure is arranged so that the wiring board 2 is directly fixed to the base plate 4 by caulking, hence making it possible to enhance the characteristics of the recording head to withstand static electricity without inviting such disadvantages as the apparatus being made larger with increased costs, among others.

Embodiment 2

Figure 3A:
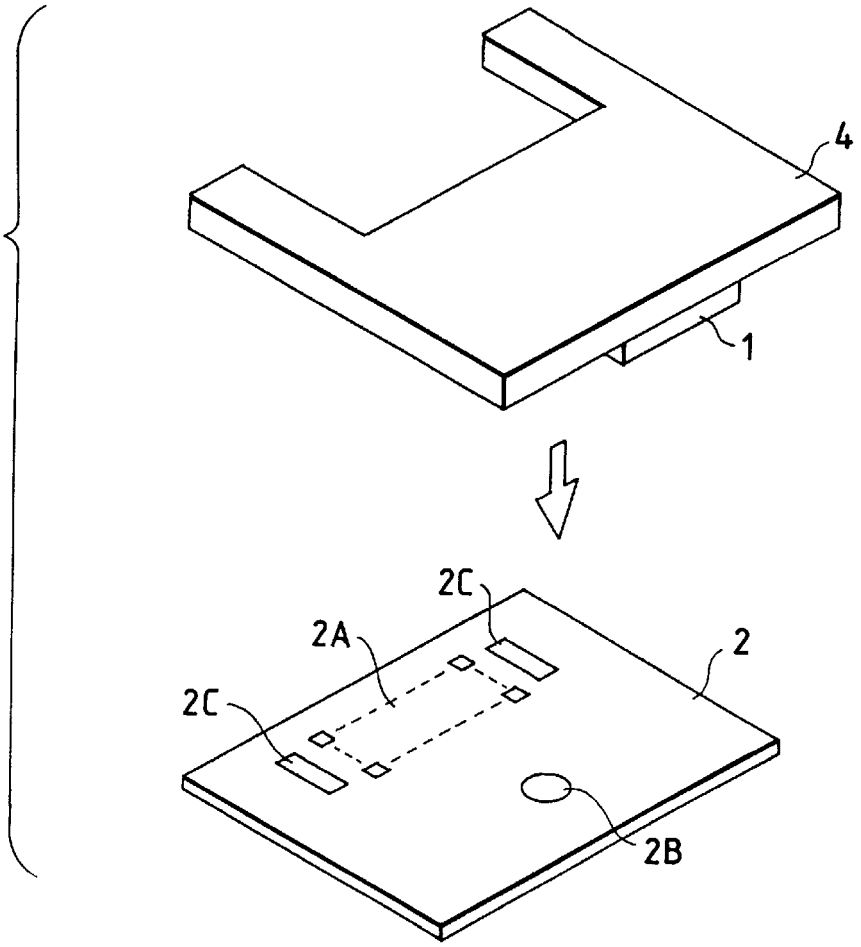
FIGS. 3A and 3B are views which schematically illustrate another embodiment of the recording head in accordance with the present invention.
Figure 3B:
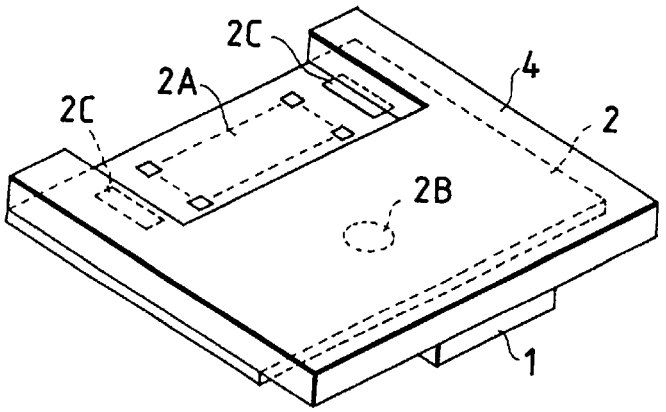

FIGS. 3A and 3B are views which show a second embodiment of the recording head in accordance with the present invention. The present embodiment is an example in which the base plate 4 serving as a supporting member, and the GND wiring on the wiring board 2 are arranged not to be directly in contact with each other. FIG. 3A is an exploded perspective view showing a state before the base plate 4 and the wiring board 2 are coupled. FIG. 3B is a perspective view illustrating a state after the base plate 4 and the wiring board 2 are coupled by the application of bonding agent.

In the present embodiment, the wiring board 2 is double faced, and provided with an electrical junction (contact pad) 2A for the apparatus main body on the coupling surface with the base plate 4. A cut-off portion is arranged on the base plate 4 corresponding to this contact section. Also, the wiring board 2 is provided with exposed portions 2B and 2C on the GND wiring pattern thereof. In a state where the base plate 4 and the wiring board 2 are coupled, the 2B is in such a condition that the pattern is exposed to the base plate 4, while the 2Cs are in such a condition that the patterns are exposed over the cut-off portion of the base plate 4. In other words, the exposed portions of the GND wiring on the wiring board and the base plate 4 are positioned extremely closely, while facing each other.

Figure 4:
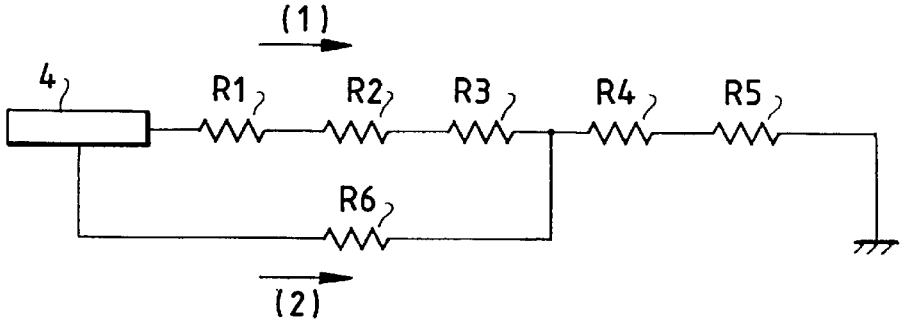
FIG. 4 is a diagram which shows the equivalent circuit of the discharging path of the recording head in accordance with the present invention.

FIG. 4 is a diagram showing a circuit arranged by representing the structure shown in FIGS. 3A and 3B as an electric circuit. In the present embodiment, the base plate 4 and the exposed portions of the GND pattern on the wiring board 2 are extremely close. Therefore, the circuit is formed so as to connect the discharge resistor R6 of the base plate 4 to the wiring board 2 in parallel with the passage of R1→R2→R3.

When the user who is electrostatically charged intends to exchange recording heads of the present embodiment in a state that the recording head is installed on a recording apparatus shown in FIG. 7, it is conceivable that, as in the Embodiment 1, there are two paths, (1) and (2) shown in FIG. 4, but compared to the conventional recording head having only one discharge path (1), the current running through the heater board 1 is reduced by the portion of the current that runs through the discharge path (2). As a result, it is possible to expand the protective margin for the recording head to withstand electrostatic destruction.

In accordance with the present embodiment, the exposed portions 2C of the GND pattern are provided over the cut-off portion of the base plate 4 in order to make the discharge resistance R6 small from the base plate 4 to the wiring board 2. This is possible because the discharge is made more easily at a pointed part such as a corner or a leading end than a flat surface.

Embodiment 3

The feature of the present embodiment is that the bonding agent used for coupling the base plate 4 and the wiring board 2 in the Embodiment 2 is made conductive. By use of a conductive bonding agent, the discharge resistance R6 represented in FIG. 4 becomes almost zero, hence making it possible to obtain the same effect as Embodiment 1.

Embodiment 4

The feature of the present embodiment is that in place of the bonding agent used for Embodiment 3, a wire bonding is adopted as means for electrically connecting the base plate 4 and the wiring board 2. In other words, it may be possible to connect the base plate 4 and the wiring board 2 by means of wire bonding when the heater board 1 and the wiring board 2 are wire bonded.

Other Embodiments

Figure 5:
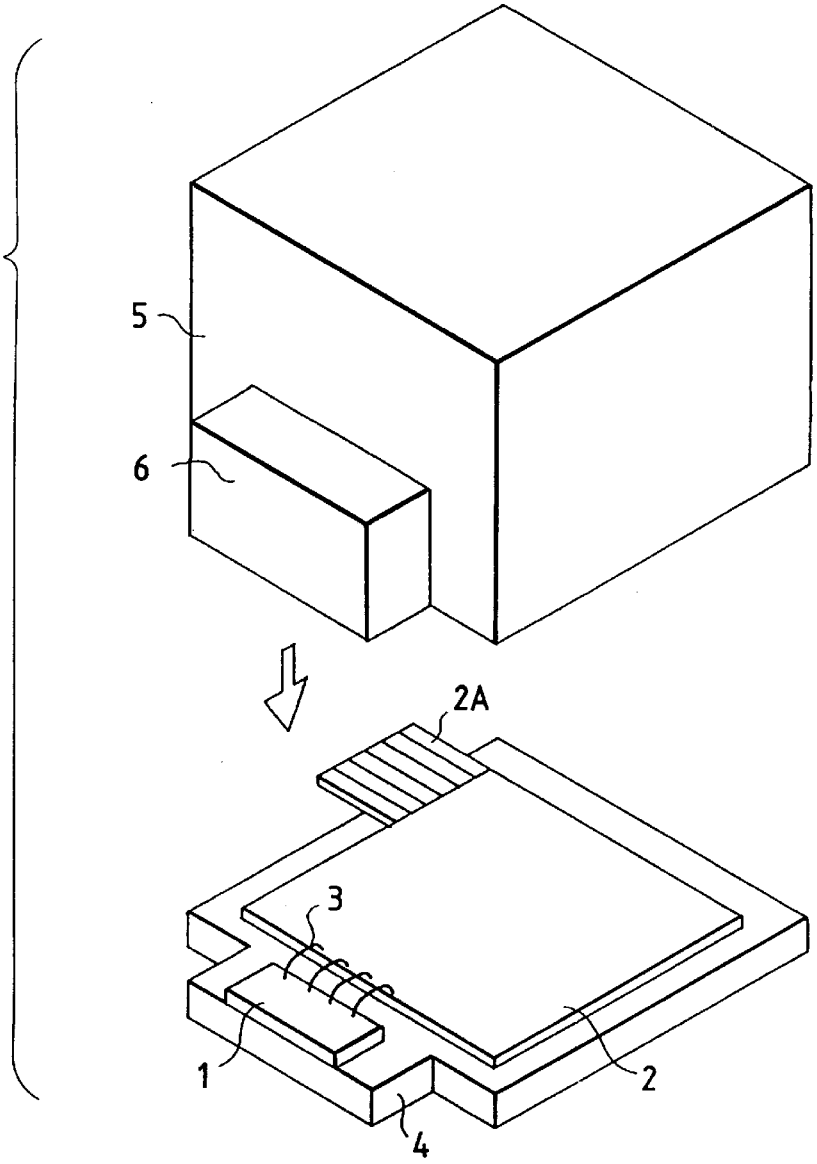
FIG. 5 PRIOR ART
FIG. 5 is a view which illustrates the principal part of a bubble jet recording head.
Figure 6:
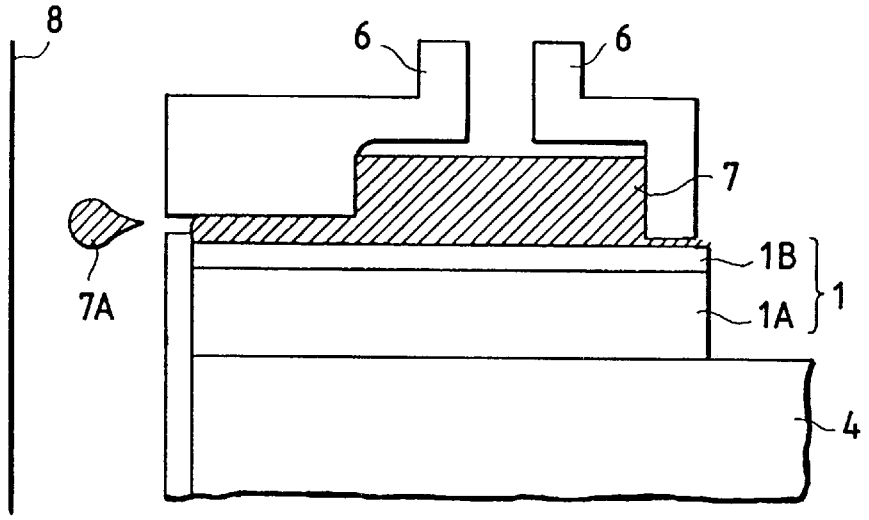
FIG. 6 PRIOR ART
FIG. 6 is a cross-sectional view which illustrates the principal part of the bubble jet recording head.

In each of the embodiments described above, only the elemental substrate, wiring board, and the like have been taken up when describing the ink jet head, but the structure of the elemental substrate, the structures of liquid paths and liquid chamber should be the same as those described in conjunction with FIG. 5. Also, the structure of the apparatus is good enough if only it is arranged as shown in FIG. 7 with the installation of any one of the heads described in the respective embodiments. Here, the head in each embodiment is to be detachably installed on the recording apparatus.

Of the ink jet recording apparatuses, the present invention is particularly effective for the one that adopts a method in which change of state of ink is created by the application of thermal energy with the provision of means (electrothermal transducing elements, laser beam, or the like, for example) for generating thermal energy to be utilized as energy for discharging ink. With a method of the kind, it is possible to achieve recording in high density and high precision.

Regarding the typical structure and operational principle of such method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system as well. Particularly, however, the method is suitable for the on-demand type because the principle is such that at least one driving signal, which provides a rapid temperature rise beyond a departure from nucleation boiling point in response to recording information, is applicable to an electrothermal transducer disposed on a liquid (ink) retaining sheet or liquid passage whereby to cause the electrothermal transducer to generate thermal energy to produce film boiling on the thermoactive portion of recording means (recording head), thus effectively leading to the resultant formation of a bubble in the recording liquid (ink) one to one for each of the driving signals. By the development and contraction of the bubble, the liquid (ink) is discharged through a discharging port to produce at least one droplet. The driving signal is more preferably in the form of pulses because the development and contraction of the bubble can be effectuated instantaneously, and, therefore, the liquid (ink) is discharged with quick response. The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid passages, and the electrothermal transducers (linear type liquid passages or right-angled liquid passages). Besides, the structure such as disclosed in the specifications of U.S. Pat. Nos. 4,558,333 and 4,459,600 wherein the thermal activation portions are arranged in a curved area is also included in the present invention.

Further, the present invention is effectively applicable to a recording head of full-line type having a length corresponding to the maximum width of a recording medium recordable by the recording apparatus. For such recording head, it may be possible to adopt either a structure whereby to satisfy the required length by combining a plurality of recording heads or a structure arranged by one integrally formed recording head.

In addition, the present invention is effectively applicable to the recording head of the serial type as in the example described above, the recording head fixed to the apparatus main body, the recording head of an exchangeable chip type, which can be electrically connected with the apparatus main body or to which ink can be supplied from the apparatus main body when it is installed in the apparatus main body, or to the recording head of a cartridge type in which an ink tank is formed integrally with the recording head itself.

Also, for the present invention, it is preferable to additionally provide a recording head with recovery means and preliminarily auxiliary means as constituents of the recording apparatus because these additional means will contribute to making the effectiveness of the present invention more stabilized. To name them specifically, these are capping means for the recording head, cleaning means, compression or suction recovery means, preheating means such as electrothermal transducers or heating elements other than such transducers or the combination of those types of elements, and predischarge means for performing discharge other than the regular discharge.

Also, regarding the kinds and numbers of recording heads to be installed, it may be possible to adopt those having plural heads for plural kinds of ink having different colors or densities, besides the one having only a single head for one monochromic ink. In other words, the present invention is applicable not only to a recording mode in which only main color such as black is used, but also to an apparatus having at least one of multiple color modes provided by ink of different colors, or a full-color mode using the mixture of the colors, irrespective of whether the recording heads are integrally structured or it is structured by a combination of plural recording heads.

Furthermore, as the mode of the recording apparatus in accordance with the present invention, it may be possible to adopt a copying apparatus combined with a reader in addition to the image output terminal for a computer, or other information processing apparatus, and also, it may be possible to adopt a mode of a facsimile apparatus having transmitting and receiving functions.

As described above, in accordance with the present invention, the base plate and the GND wiring on the wiring board are connected or the base plate and the exposed portions of the GND wiring on the wiring board are closely arranged, thus making it possible to enhance the characteristics of a recording head to withstand static electricity without inviting such disadvantages as making the apparatus larger and increasing costs, among others.

What is claimed is:

1. An ink jet head for use in a recording apparatus having a recording apparatus side, said recording head comprising:

an elemental substrate having a plurality of heat generating elements for discharging an ink, and a plurality of functional elements arranged thereon for driving said plurality of heat generating elements individually;

a wiring board for electrically connecting said elemental substrate and the recording apparatus side of the recording apparatus, said wiring board having a plurality of wires for supplying a signal for driving said heat generating elements from the recording apparatus side to the functional elements on said elemental substrate, and a plurality of grounding wires for grounding a potential of the elemental substrate to the recording apparatus side; and a conductive supporting member for supporting said wiring board and said elemental substrate thereon, wherein the grounding wires on said wiring board and said supporting member are electrically connected so that a static electric charge of said conductive supporting member is discharged to the apparatus side through said grounding wires.

2. An ink jet head according to claim 1, further comprising an ink container.

3. An ink jet head for use in a recording apparatus having a recording apparatus side, said recording head comprising:

an elemental substrate having a plurality of heat generating elements for discharging an ink, and a plurality of functional elements arranged thereon for driving said plurality of heat generating elements individually;

a wiring board for electrically connecting said elemental substrate with the recording apparatus side of the recording apparatus, said wiring board having a plurality of wires for supplying a signal for driving said heat generating elements from the recording apparatus side to the functional elements on said elemental substrate, and a plurality of grounding wires for grounding a potential of the elemental substrate to the recording apparatus side, the grounding wires having a plurality of parts, respectively; and a conductive supporting member for supporting said wiring board and said elemental substrate thereon, wherein the parts of the grounding wires on said wiring board are exposed, and said exposed portions and said supporting member are closely arranged so that a static electric charge of said conductive supporting member is discharged to the recording apparatus side through said grounding wires.

4. An ink jet head according to claim 1 or claim 3, wherein said supporting member is a metallic plate.

5. An ink jet head according to claim 4, wherein said heat generating elements are electrothermal transducing elements for generating thermal energy to cause film boiling in ink.

6. An ink jet head according to claim 3, wherein said exposed portions of the wiring pattern are arranged on the edge portion of said supporting member.

7. An ink jet head according to claim 1 or claim 3, wherein said wiring is GND wiring having a ground potential.

8. An ink jet head according to claim 7, wherein said heat generating elements are electrothermal transducing elements for generating thermal energy to cause film boiling in ink.

9. An ink jet head according to claim 1 or claim 3, wherein said heat generating elements are electrothermal transducing elements for generating thermal energy to cause film boiling in ink.

10. An ink jet head according to claim 3, wherein said exposed portions and said supporting member are arranged to face each other.

11. An ink jet head according to claim 10, wherein said exposed portions and said supporting member are arranged to face each other through a bonding agent.

12. A recording apparatus having a recording apparatus side, comprising:

an ink jet head comprising;

an elemental substrate having a plurality of heat generating elements for discharging an ink, and a plurality of functional elements arranged thereon for driving said plurality of heat generating elements individually, a wiring board for electrically connecting said elemental substrate and the recording apparatus side of the recording apparatus, said wiring board having a plurality of wires for supplying a signal for driving said heat generating elements from the recording apparatus side to the functional elements on said elemental substrate, and a plurality of grounding wires for grounding a potential of the elemental substrate to the recording apparatus side, and a conductive supporting member for supporting said wiring board and said elemental substrate thereon, wherein the grounding wires on said wiring board and said supporting member are electrically connected so that a static electric charge of said conductive supporting member is discharged to the apparatus side through said grounding wires.

13. A recording apparatus according to claim 12, wherein said recording head is detachably arranged therefor.

14. A recording apparatus according to claim 12, further comprising:

an ink container; and supply means for supplying ink from the ink container to the ink jet head.

15. A recording apparatus having a recording apparatus side and comprising:

an ink jet head having;

an elemental substrate having a plurality of heat generating elements for discharging an ink, and a plurality of functional elements arranged thereon for driving said plurality of heat generating elements individually;

a wiring board for electrically connecting said elemental substrate and the recording apparatus side of the recording apparatus, said wiring board having a plurality of wires for supplying a signal for driving said heat generating elements from the recording apparatus side to the functional elements on said elemental substrate, and a plurality of grounding wires for grounding a potential of the elemental substrate to the recording apparatus side; and a conductive supporting member for supporting said wiring board and said elemental substrate thereon, said supporting member being a metallic plate, and wherein the grounding wires on said wiring board and said supporting member are electrically connected so that a static electric charge of said conductive supporting member is discharged to the apparatus side through said grounding wires.

16. A recording apparatus having a recording apparatus side and comprising:

an ink jet head having;

an elemental substrate having a plurality of heat generating elements for discharging an ink, and a plurality of functional elements arranged thereon for driving said plurality of heat generating elements individually;

a wiring board for electrically connecting said elemental substrate with the recording apparatus side of the recording apparatus, said wiring board having a plurality of wires for supplying a signal for driving said heat generating elements from the recording apparatus side to the functional elements on said elemental substrate, and a plurality of grounding wires for grounding a potential of the elemental substrate to the recording apparatus side, the grounding wires having a plurality of parts, respectively; and a conductive supporting member for supporting said wiring board and said elemental substrate thereon, wherein the parts of the grounding wires on said wiring board are exposed, and said exposed portions and said supporting member are closely arranged so that a static electric charge of said conductive supporting member is discharged to the recording apparatus side through said grounding wires, said exposed portions of the wiring pattern being arranged on the edge portion of said supporting member.

17. A recording apparatus having a recording apparatus side and comprising:

an ink jet head having;

an elemental substrate having a plurality of heat generating elements for discharging an ink, and a plurality of functional elements arranged thereon for driving said plurality of heat generating elements individually;

a wiring board for electrically connecting said elemental substrate and the recording apparatus side of the recording apparatus, said wiring board having a plurality of wires for supplying a signal for driving said heat generating elements from the recording apparatus side to the functional elements on said elemental substrate, and a plurality of grounding wires for grounding a potential of the elemental substrate to the recording apparatus side; and a conductive supporting member for supporting said wiring board and said elemental substrate thereon, wherein the grounding wires on said wiring board and said supporting member are electrically connected so that a static electric charge of said conductive supporting member is discharged to the apparatus side through said grounding wires, and the grounding wires are GND wiring having a around potential.

18. A recording apparatus having a recording apparatus side and comprising:

an ink jet head having;

an elemental substrate having a plurality of heat generating elements for discharging an ink, said heat generating elements being electrothermal transducing elements for generating thermal energy to cause film boiling in an ink, and a plurality of functional elements arranged thereon for driving said plurality of heat generating elements individually;

a wiring board for electrically connecting said elemental substrate and the recording apparatus side of the recording apparatus, said wiring board having a plurality of wires for supplying a signal for driving said heat generating elements from the recording apparatus side to the functional elements on said elemental substrate, and a plurality of grounding wires for grounding a potential of the elemental substrate to the recording apparatus side; and a conductive supporting member for supporting said wiring board and said elemental substrate thereon, wherein the grounding wires on said wiring board and said supporting member are electrically connected so that a static electric charge of said conductive supporting member is discharged to the apparatus side through said grounding wires.

19. A recording apparatus having a recording apparatus side and comprising:

an ink jet head having;

an elemental substrate having a plurality of heat generating elements for discharging an ink, and a plurality of functional elements arranged thereon for driving said plurality of heat generating elements individually;

a wiring board for electrically connecting said elemental substrate with the recording apparatus side of the recording apparatus, said wiring board having a plurality of wires for supplying a signal for driving said heat generating elements from the recording apparatus side to the functional elements on said elemental substrate, and a plurality of grounding wires for grounding a potential of the elemental substrate to the recording apparatus side, the grounding wires having a plurality of parts, respectively; and a conductive supporting member for supporting said wiring board and said elemental substrate thereon, wherein the parts of the grounding wires on said wiring board are exposed, and said exposed portions and said supporting member are closely arranged so that a static electric charge of said conductive supporting member is discharged to the recording apparatus side through said grounding wires, and said exposed portions and said supporting member are arranged to face each other.

20. A recording apparatus having a recording apparatus side and comprising:

an ink jet head having;

an elemental substrate having a plurality of heat generating elements for discharging an ink, and a plurality of functional elements arranged thereon for driving said plurality of heat generating elements individually;

a wiring board for electrically connecting said elemental substrate with the recording apparatus side of the recording apparatus, said wiring board having a plurality of wires for supplying a signal for driving said heat generating elements from the recording apparatus side to the functional elements on said elemental substrate, and a plurality of grounding wires for grounding a potential of the elemental substrate to the recording apparatus side, the grounding wires having a plurality of parts, respectively; and a conductive supporting member for supporting said wiring board and said elemental substrate thereon, said supporting member being a metallic plate, wherein the parts of the grounding wires on said wiring board are exposed, and said exposed portions and said supporting member are closely arranged so that a static electric charge of said conductive supporting member is discharged to the recording apparatus side through said grounding wires.

21. A recording apparatus having a recording apparatus side and comprising:

an ink jet head having;

an elemental substrate having a plurality of heat generating elements for discharging an ink, and a plurality of functional elements arranged thereon for driving said plurality of heat generating elements individually;

a wiring board for electrically connecting said elemental substrate with the recording apparatus side of the recording apparatus, said wiring board having a plurality of wires for supplying a signal for driving said heat generating elements from the recording apparatus side to the functional elements on said elemental substrate, and a plurality of grounding wires for grounding a potential of the elemental substrate to the recording apparatus side, the grounding wires having a plurality of parts, respectively; and a conductive supporting member for supporting said wiring board and said elemental substrate thereon, wherein the parts of the grounding wires on said wiring board are exposed, and said exposed portions and said supporting member are closely arranged so that a static electric charge of said conductive supporting member is discharged to the recording apparatus side through said grounding wires, and said grounding wires are GND wiring having a ground potential.

22. A recording apparatus having a recording apparatus side and comprising:

an ink jet head having;

an elemental substrate having a plurality of heat generating elements for discharging an ink, said heat generating elements being electrothermal transducing elements for generating thermal energy to cause film boiling in ink, and a plurality of functional elements arranged thereon for driving said plurality of heat generating elements individually;

a wiring board for electrically connecting said elemental substrate with the recording apparatus side of the recording apparatus, said wiring board having a plurality of wires for supplying a signal for driving said heat generating elements from the recording apparatus side to the functional elements on said elemental substrate, and a plurality of grounding wires for grounding a potential of the elemental substrate to the recording apparatus side, the grounding wires having a plurality of parts, respectively; and a conductive supporting member for supporting said wiring board and said elemental substrate thereon, wherein the parts of the grounding wires on said wiring board are exposed, and said exposed portions and said supporting member are closely arranged so that a static electric charge of said conductive supporting member is discharged to the recording apparatus side through said grounding wires.

23. A recording apparatus having a recording apparatus side, comprising:

a recording head, comprising;

an elemental substrate having a plurality of heat generating elements for discharging an ink, and a plurality of functional elements arranged thereon for driving said plurality of heat generating elements individually, a wiring board for electrically connecting said elemental substrate with the recording apparatus side of the recording apparatus, said wiring board having a plurality of wires for supplying a signal for driving said heat generating elements from the recording apparatus side to the functional elements on said elemental substrate, and a plurality of grounding wires for grounding a potential of the elemental substrate to the recording apparatus side, the grounding wires having a plurality of parts, respectively, and a conductive supporting member for supporting said wiring board and said elemental substrate thereon, wherein the parts of the grounding wires on said wiring board are exposed, and said exposed portions and said supporting member are closely arranged so that a static electric charge of said conductive supporting member is discharged to the recording apparatus side through said grounding wires.

24. A recording apparatus according to claim 23, wherein said exposed portions and said supporting member are arranged to face each other.

25. An ink jet head according to claim 24, wherein said exposed portions and said supporting member are arranged to face each other through a bonding agent.

* * * * *

UNITED STATES PATENT AND TRADEMARK OFFICE

CERTIFICATE OF CORRECTION

PATENT NO. : 5,988,796

DATED : November 23, 1999

INVENTOR(S) : AKIHIRO YAMANAKA

It is certified that error appears in the above-identified patent and that said Letters Patent is hereby corrected as shown below:

COLUMN 1

Line 11, "(print)" should read --(printing)--.

COLUMN 4

Line 37, "insulator" should read --insulator,--;
Line 38, "conductive" should read --conductive,--; and
Line 67, "al" should read --al.--.

COLUMN 5

Line 39, "2B" should read --portion 2B--.

COLUMN 7

Line 50, "main" should read --a main--.

UNITED STATES PATENT AND TRADEMARK OFFICE

CERTIFICATE OF CORRECTION

PATENT NO. : 5,988,796

DATED : November 23, 1999

INVENTOR(S) : AKIHIRO YAMANAKA

It is certified that error appears in the above-identified patent and that said Letters Patent is hereby corrected as shown below:

COLUMN 10

Line 56, "around" should --ground--.

Signed and Sealed this

Twenty-sixth Day of December, 2000

*Attest:*

Q. TODD DICKINSON

*Attesting Officer*

*Director of Patents and Trademarks*